US008783523B2

(12) United States Patent
Dumont et al.

(10) Patent No.: US 8,783,523 B2
(45) Date of Patent: Jul. 22, 2014

(54) BOTTLE FOR DISPENSING A FLUID PRODUCT

(75) Inventors: Pierre Dumont, Dargnies (FR); Jacky Lasnier, Sainte Marguerite sur Duclair (FR); Jean-Luc Marcel Octau, Intraville (FR); Mohamed Elmeguenni, Le Treport (FR); Bernard Clerget, Haudivillers (FR); Emmanuel Mauduit, Eu (FR); Thomas Roosel, Notre Dame d'Aliermont (FR)

(73) Assignee: Rexam Dispensing Systems S.A.S. (FR)

( * ) Notice: Subject to any disclaimer, the term of this patent is extended or adjusted under 35 U.S.C. 154(b) by 0 days.

(21) Appl. No.: 13/486,496

(22) Filed: Jun. 1, 2012

(65) Prior Publication Data

US 2012/0312842 A1 Dec. 13, 2012

(30) Foreign Application Priority Data

Jun. 8, 2011 (FR) ..... 11 55008

(51) Int. Cl.
*B65D 88/54* (2006.01)

(52) U.S. Cl.
USPC ..... 222/321.9; 222/321.2; 222/562; 141/113

(58) Field of Classification Search
USPC ..... 222/321.4, 321.2, 400.7, 335, 378, 207, 222/522, 190, 153.1, 153.05, 321.9, 153.12, 222/402.13, 153.14, 182, 402.12, 562, 549, 222/529, 494; 141/2, 18, 25–27, 113, 301, 141/323; 73/46; 206/222, 219
See application file for complete search history.

(56) References Cited

U.S. PATENT DOCUMENTS

| | | | | | |
|---|---|---|---|---|---|
| 2,443,981 | A | * | 6/1948 | Funk et al. | 222/259 |
| 2,870,943 | A | * | 1/1959 | Scoggin, Jr. | 222/182 |
| 2,956,509 | A | * | 10/1960 | Cooprider et al. | 417/561 |
| 3,050,219 | A | * | 8/1962 | Sagarin et al. | 222/549 |
| 4,981,233 | A | * | 1/1991 | Scheurer | 220/212 |
| 5,772,083 | A | * | 6/1998 | Joulia | 222/396 |
| 5,791,527 | A | * | 8/1998 | Giuffredi | 222/321.9 |

(Continued)

FOREIGN PATENT DOCUMENTS

| | | | |
|---|---|---|---|
| CA | 2744037 | A1 | 7/2010 |
| FR | 2854131 | A1 | 10/2004 |

OTHER PUBLICATIONS

French Search Report; Application No. FR 1155008; Issued: Nov. 21, 2011; 6 pages.

*Primary Examiner* — Frederick C Nicolas
*Assistant Examiner* — Bob Zadeh
(74) *Attorney, Agent, or Firm* — St. Onge Steward Johnston & Reens LLC

(57) ABSTRACT

A bottle for dispensing a fluid product including a body wherein a reservoir is formed, the bottle including a device for sampling having a push-button with a dispensing orifice for the product, the push-button able to be displaced reversibly on an actuating stroke of the device between a position at rest and a depressed position wherein the dispensing orifice is in communication with the reservoir by the intermediary of the device, the body including a filling valve, the reservoir having an air depression arranged to carry out filling of the reservoir through suction of the product contained in a source, the bottle further including a cap which is associated to the body by forming a sealed internal space wherein the push-button is arranged, the internal space having an air depression and being arranged to maintain the push-button in depressed position to be in communication with the reservoir.

13 Claims, 4 Drawing Sheets

(56) References Cited

U.S. PATENT DOCUMENTS

| | | | | |
|---|---|---|---|---|
| 6,112,949 | A * | 9/2000 | Rhodes et al. | 222/153.02 |
| 6,863,093 | B2 * | 3/2005 | Garcia et al. | 141/2 |
| 6,948,639 | B2 * | 9/2005 | Albisetti et al. | 222/321.2 |
| 6,997,219 | B2 * | 2/2006 | Py et al. | 141/314 |
| 7,467,732 | B2 * | 12/2008 | Bougamont | 222/321.9 |
| 7,743,949 | B2 * | 6/2010 | Ramet | 222/321.9 |
| 7,870,952 | B2 * | 1/2011 | Fontana | 206/222 |
| 8,079,388 | B2 * | 12/2011 | Turgeman | 141/113 |
| 2010/0200615 | A1 * | 8/2010 | Ciavarella | 222/190 |
| 2011/0024438 | A1 * | 2/2011 | Valles et al. | 220/780 |
| 2011/0309113 | A1 * | 12/2011 | Hui et al. | 222/402.16 |

* cited by examiner

BOTTLE FOR DISPENSING A FLUID PRODUCT

CROSS-REFERENCE TO RELATED APPLICATIONS

The present application claims priority of French Patent Application No. 11 55008 filed on Jun. 8, 2011, the content of which is incorporated herein by reference.

FIELD OF THE INVENTION

The invention relates to a bottle for dispensing a fluid product, in particular liquid, for example a cosmetic care product, makeup or perfumery product, or a pharmaceutical product.

BACKGROUND OF THE INVENTION

The bottle for dispensing comprises a body wherein a reservoir for conditioning the product is formed, as well as a device for sampling the conditioned product which is mounted in a sealed manner on said body. In particular, the device for sampling can include a manually-actuated pump which is supplied with conditioned product, said pump being arranged to distribute the product under pressure, for example in the form of an aerosol.

To do this, the device for sampling is provided with a push-button which is provided with a dispensing orifice of the product, said push-button able to be displaced reversibly on an actuating stroke of said device between a position at rest and a depressed position wherein the dispensing orifice is in communication with the reservoir by the intermediary of said device.

In an application example, the bottles according to the invention allow for the dispensing of samples of product, in particular for a volume of product conditioned in the reservoir which is between 1 and 10 ml. In particular, the samples distributed as such can allow a customer to test the product, the bottles then being qualified as sample test bottles. Alternatively, the bottles can be said to be "travel size" in that they make it possible to easily transport a reduced volume of product, as opposed to bottles of a higher capacity which are in general heavy and cumbersome as they are complete.

In these applications, for example for reasons of logistics, practicality or environmental reasons concerning recycling, it may be desirable to be able to refill the reservoir with product using a source of said product. Indeed, it is not very practical for a user to carry out the filling of the reservoir using a small funnel and it is not very ecological to discard an empty bottle in order to replace it with a full bottle constituting a refill.

Bottles for dispensing are already proposed for sale, wherein the body is provided with a filling valve of the reservoir which is arranged in order to allow for a putting into communication of a source of product with said reservoir. In particular, the valve can open via the pressing on the nozzle of the pump of a source bottle that is to be actuated several times in order to carry out the filling, which is a gesture that is not very intuitive for the user.

Document FR-2 854 131 provides for the emptying of a reservoir by means of an airless pump in the reservoir 2 for conditioning as compensation for the volume of product distributed in such a way as to create an air depression in said reservoir, said depression making it possible to carry out the filling of said reservoir via suction of the source product.

Bottles for dispensing have also been proposed wherein the reservoir is devoid of product and which have an air depression that is arranged to be able to subsequently carry out the initial filling of the reservoir with product by the sealed putting into communication of a product source with said reservoir by the intermediary of a valve in such a way that said depression induces the filling of said reservoir through suction of the product contained in said source.

However, in solutions for filling via suction, the problem arises of storage over time of the air depression in the reservoir. Indeed, devices for sampling are never perfectly sealed against microleakage as they include many zones for sealing via tightening and are comprised of plastic or elastomeric materials which, over time, become slightly porous to air.

SUMMARY OF THE INVENTION

The invention aims to improve prior art by proposing in particular a bottle for dispensing wherein an air depression in the reservoir can be stored in an extended manner over time, in particular during the storage of the bottle before its initial filling, in such a way as to make reliable the filling capacity via suction of said reservoir by the sealed putting into communication of a product source with said reservoir.

To this effect, the invention proposes a bottle for dispensing a fluid product comprising a body wherein a reservoir intended for the conditioning of said product is formed, said bottle further comprising a device for sampling said conditioned product which is mounted in a sealed manner on said body, said device for sampling being provided with a push-button which is provided with a dispensing orifice of said product, said push-button able to be displaced reversibly on an actuating stroke of said device between a position at rest and a depressed position wherein the dispensing orifice is in communication with the reservoir by the intermediary of said device, said body being equipped with a filling valve of said reservoir which is arranged in order to allow for the putting into communication of a product source with said reservoir, the reservoir having an air depression which is arranged in order to be able to carry out the filling of the reservoir with product by the sealed putting into communication of a product source with said reservoir by the intermediary of the valve in such a way that said depression induces the filling of said reservoir through suction of the product contained in said source, said bottle further comprising a cap which is associated to the body by forming a sealed internal space wherein said push-button is arranged, said internal space having an air depression and being arranged in order to maintain said push-button in depressed position in such a way as to be in communication with the reservoir.

BRIEF DESCRIPTION OF THE DRAWINGS

Other purposes and advantages of the invention shall appear in the following description, made in reference to FIGS. 1 to 6.

DETAILED DESCRIPTION OF THE INVENTION

Figure 1:
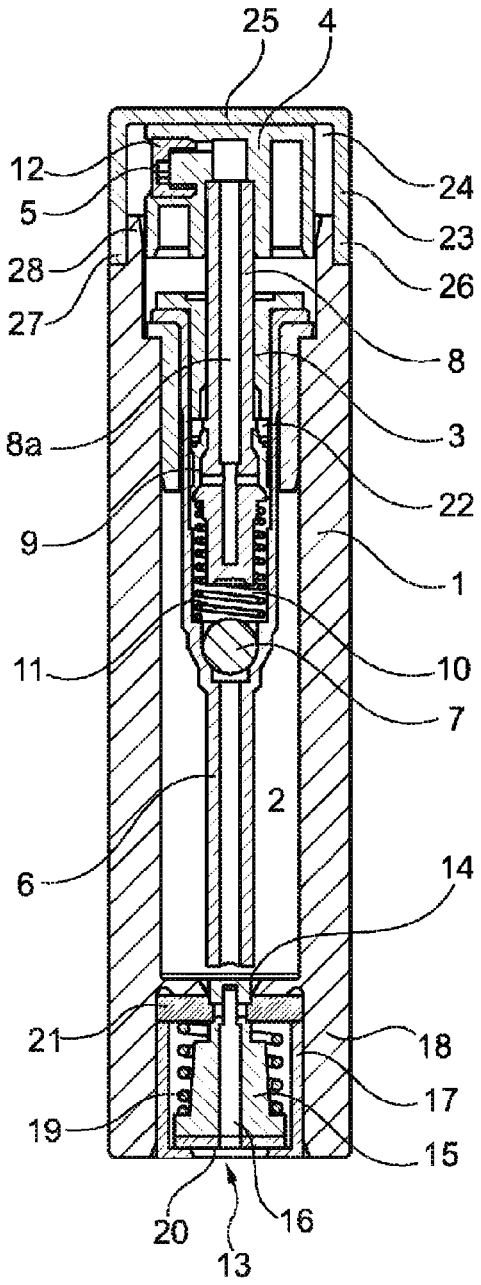
FIG. 1 shows a longitudinal section of a bottle for dispensing according to an embodiment of the invention.

In the description, the terms of positioning in space are taken in reference to the position of the bottle shown in the figures.

In relation with the figures, hereinbelow is described a bottle intended to contain a fluid product to be dispensed. In particular examples, the product can be liquid, in particular a cosmetic care product, makeup or perfumery product, or a pharmaceutical product.

The bottle comprises a body 1 wherein a reservoir 2 for conditioning the product is formed. According to a particular application, the reservoir 2 can have a capacity between 1 and 10 ml in such a way as to allow for the dispensing of product samples.

In the embodiments shown, the body 1 is rigid, in particular having a rigidity that is sufficient for the volume of the reservoir 2 to remain substantially constant. The body 1 can be of a single piece, for example made via air-blow injection or air-blown extrusion, or from several injected and then assembled parts, for example via ultrasonic welding or via rotating friction, from rigid plastic material, from metal, for example from aluminium, or from glass. In an alternative not shown, the body 1 can be flexible, in particular deformable during the dispensing of the product.

The bottle comprises a device for sampling 3 the conditioned product which is mounted in a sealed manner on the body 1, in particular in the upper opening of said body. The device for sampling 3 is provided with a push-button 4 which is provided with a dispensing orifice 5 for said product, said push-button able to be displaced reversibly on an actuating stroke of said device between a position at rest and a depressed position wherein the dispensing orifice 5 is in communication with the reservoir 2 by the intermediary of said device.

In the embodiments shown, the device for sampling comprises a dispensing pump 3 actuated manually by means of a push-button 4 which is supplied with the product under pressure with the purpose of dispensing it.

The pump 3 comprises means of supplying with conditioned product that, in the figures, include a plunger tube 6 arranged in the reservoir 2, said tube being provided with an inlet valve 7 of the product in the pump 3. The push-button 4 is mounted on the nozzle 8 of the pump 3 by placing the dispensing orifice 5 in communication with an outlet channel 8*a* of said nozzle.

The pump 3 further comprises a piston 9 mounted around the nozzle 8 in order to delimit a metering chamber 10, said nozzle able to be displaced reversibly over a dispensing stroke—respectively for section—wherein the piston 9 opens—respectively closes—the communication between the outlet channel 8*a* and the metering chamber 10.

The push-button 4 comprises an upper zone allowing the user to exert pressure with a finger on said push-button in order to be able to displace the nozzle 8 on its dispensing stroke to a depressed position of said push-button, the return of the push-button 4 to the position of rest on the suction stroke of the nozzle 8 being conventionally carried out by a spring 11.

The push-button 4 is provided with a spray nozzle 12 which is arranged to radially distribute an aerosol of the product through the dispensing orifice 5. However, the invention is not limited to a particular method for dispensing the product. In particular, especially for a nasal spray tip, the push-button 4 can allow for an axial of the product and another type of device for sampling 3 can be considered.

Figure 5:
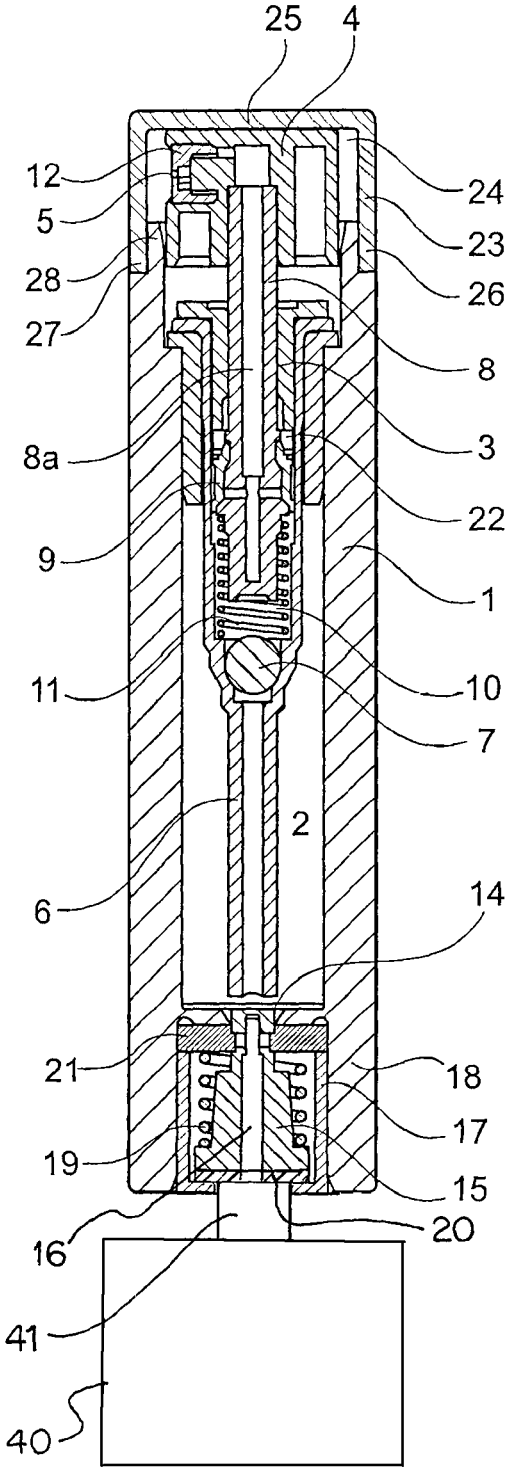
FIG. 5 shows a longitudinal section of a bottle for dispensing according to an embodiment of the invention.

The body 1 of the bottle is provided with a filling valve 13 of the reservoir 2 which is arranged in order to allow for the putting into communication of a product source with said reservoir. As shown in FIG. 5. The product source can include a source reservoir 40 whereon is arranged an outlet tube 41, with the filling of the product of the reservoir 2 being carried out by mounting said tube 41 bearing in a sealed manner on the valve 13 which is arranged to be opened in a reversible manner.

In particular, a feed bottle of a higher capacity can be used as a source of product, said bottle being provided with a pump of which the push-button is removed in order to allow for the arrangement of the nozzle bearing in a sealed manner on the valve 13. Indeed, in addition to the opening of the valve 13, the bearing in a sealed manner causes the opening of the pump in order to allow for the passage of the filling product through it.

According to another embodiment, the reservoir source is formed inside a flexible pocket which can be filled with product without air or gas for the good preservation of said product. The transfer of the product in the reservoir 2 is then possible in all positions and the flexible pocket cannot be diverted from its role as a source since without propulsion gas or internal pressure, or push-button to actuate a possible pump or valve associated to the outlet tube.

In the embodiments shown, the filling valve 13 is arranged on the lower end of the body 1, in such a way in particular as to fill the reservoir 2 via the bottom of the bottle, which corresponds to an intuitive gesture.

To do this, the lower end of the body 1 has a communication orifice 14 with the reservoir 2 and the valve 13 has a nozzle 15 which is mobile between a stable sealed closing state of the orifice 14 and a constrained opening state of said orifice for the putting into sealed communication of the product source with said reservoir.

In relation with the figures, the nozzle 15 is provided with an internal channel 16, said nozzle being mounted in translation in a ring 17 which is fixed in a sealed manner in a cage 18 formed under the body 1. The valve 13 further comprises a return spring 19 of the nozzle 15 in closed position and two respectively external 20 and internal 21 seals in order to seal the mounting of the nozzle 15 in the ring 17 and the putting into communication of the product source on said nozzle.

The reservoir 2 has an air depression which is arranged to be able to carry out the filling of said reservoir with product by putting into a sealed communication of the product source with said reservoir by the intermediary of the valve 13 in such a way that said depression induces the filling of said reservoir through suction of the product contained in said source. In particular, the air depression can be of a magnitude of −980 hPa.

According to an embodiment, the air depression can be carried out by emptying the reservoir 2 by means of a device for sampling 3 of the airless type in the reservoir 2 in compensation for the volume of product distributed, with the suction of the source product then being used to refill said reservoir.

According to another embodiment, the reservoir 2 can be devoid of product and have an initial air depression which is used to carry out the first filling of said reservoir with product. The device for sampling 3 can then be of the airless type in order to allow for subsequent fillings or with air in order to limit the use of the bottle to a single filling. In the embodiments shown, the pump 3 has a vent hole 22 that is arranged in order to make it possible to compensate for the volume of product sampled in the reservoir 2 by air.

The bottle further comprises a cap 23 which is associated to the body 1 by forming a sealed internal space 24 wherein the push-button 4 is arranged, said internal space having an air depression and being arranged to maintain said push-button in depressed position in such a way as to be in communication with the reservoir 2. As such, a pressure balance is carried out between the internal space 24 of the cap 23 and the reservoir 2.

In particular, the internal space 24 is in communication with the reservoir 2 since, in depressed position of the push-button 4, the outlet channel 8*a* of the nozzle 8 and therefore the dispensing orifice 5 exit into said internal space is in communication with the reservoir 2 by the intermediary of the metering chamber 10. Furthermore, the internal space 24 is in communication with the reservoir 2 by the intermediary of the vent hole 22.

As such, the sealing of the air depression of the reservoir 2 is not carried out on the device for sampling 3 which is maintained in open position, but by the association of the cap 23 on the body 1, said association able to be easily arranged in order to maintain over time said air depression, in particular without required a modification of the device for sampling 3.

The sealed association between the cap 23 and the body 1 can be carried out under the effect of the air depression in such a way as to make it possible to view an accidental loss of this depression since the dissociation of the cap 23 no longer makes it possible to maintain the push-button 4 in depressed position. As such, the cap 23 can be used as an empty indicator in order to show the operator whether or not the bottle can be filled via suction. Furthermore, this embodiment makes it possible, during the filling of the reservoir 2, to dissociate the cap 23 of the body 1 in such a way as to allow for the return of the push-button 4 to the position at rest.

In the embodiments shown, the cap 23 has an upper wall 25 which is pressing on the push-button 4 in order to maintain it in depressed position, said wall being surrounded by a skirt 26 having a sealed association surface 27 on a wall 28 of the body 1.

In particular, the association surface 27 can be deformed under the effect of the air depression in order to provide for its tight seal on the wall 28, said tightening able to be very low and even zero when the pressure of the internal space 24 is close to that present outside the cap 23.

The wall 28 shown extends around an upper annular collar of the body 1 wherein the push-button 4 is mounted, with the association surface 27 being formed inside the free edge of the skirt 26 which is mounted around said wall in order to be radially tightened on said wall.

Figure 2:
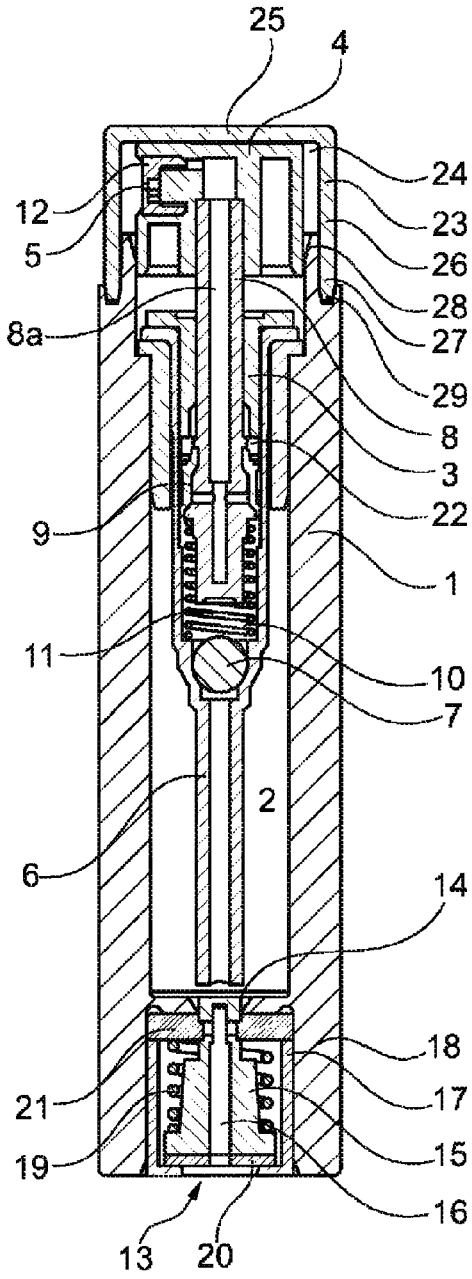
FIG. 2 shows a longitudinal section of a bottle for dispensing according to an embodiment of the invention.

In FIG. 2, the body 1 has a groove 29 wherein the association surface 27 is arranged in order to be thrust in the corner on the wall 28 in such a way as to favour the pressing on the push-button 4. More precisely, the groove 29 is formed around the base of the collar, the lower end of the skirt 26 being mounted in said groove which has a V-shaped section in order to provide for the tightening in corners.

Figure 3:
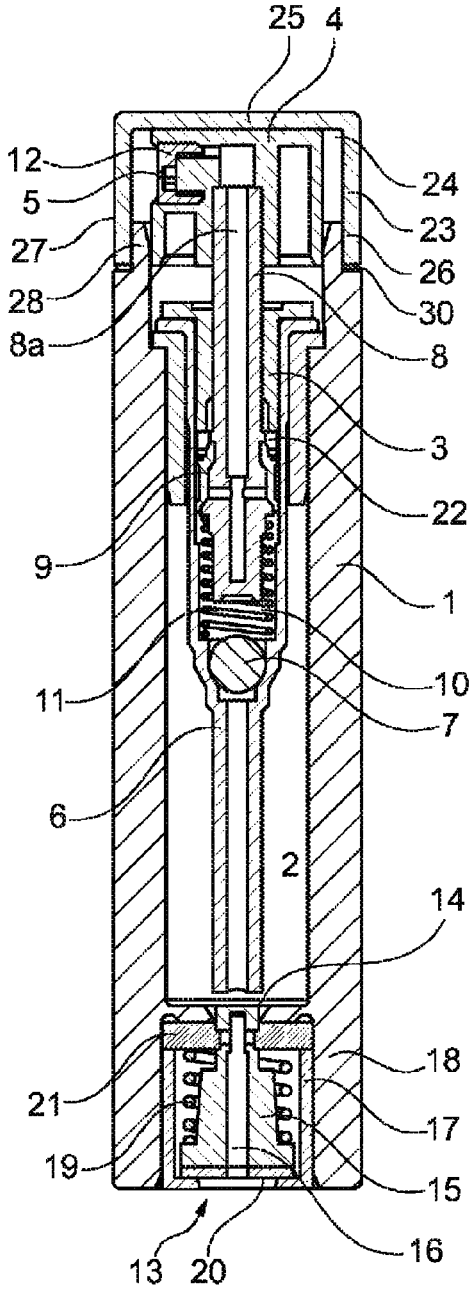
FIG. 3 shows a longitudinal section of a bottle for dispensing according to an embodiment of the invention.

In FIG. 3, a seal 30 is inserted between the association surface 27 and the wall 28 of the body 1, said seal being associated on the lower end of the skirt 26 in order to be compressed on the base of the collar.

Figure 6:
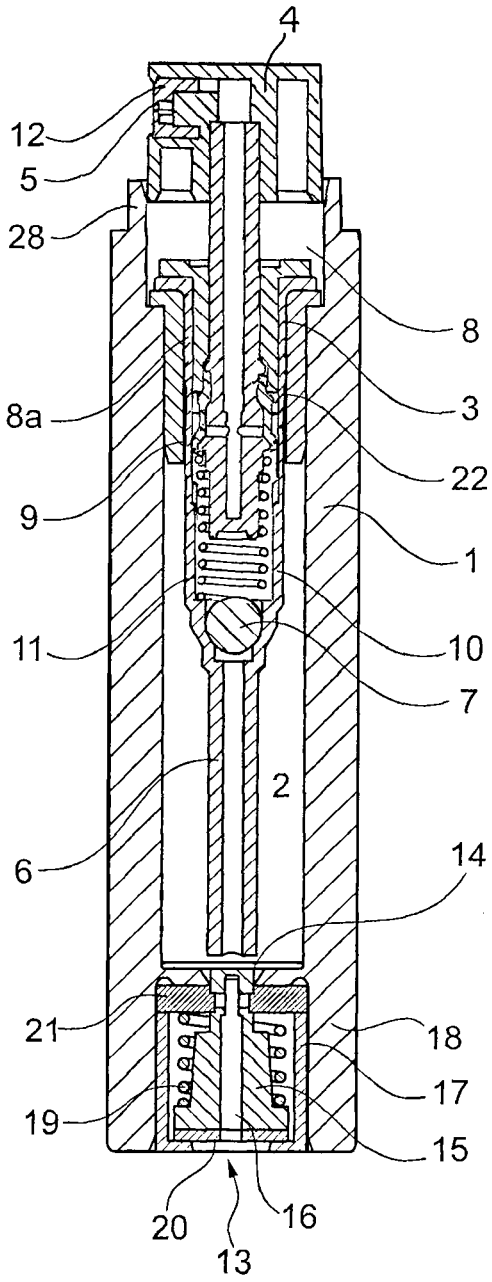
FIG. 6 shows a longitudinal section of a bottle for dispensing according to an embodiment of the invention.

In relation with FIGS. 1 to 3, the skirt 26 is rigid and has an axial dimension which is arranged in order to maintain the push-button 4 in depressed position. Furthermore, the association surface 27 can have an axial dimension which is less than the actuating stroke of the push-button 4 in such a way as to prevent the mounting of the cap 23 when the push-button 4 is in the position of rest (as shown in FIG. 6), in particular after the filling of the reservoir 2.

Figure 4:
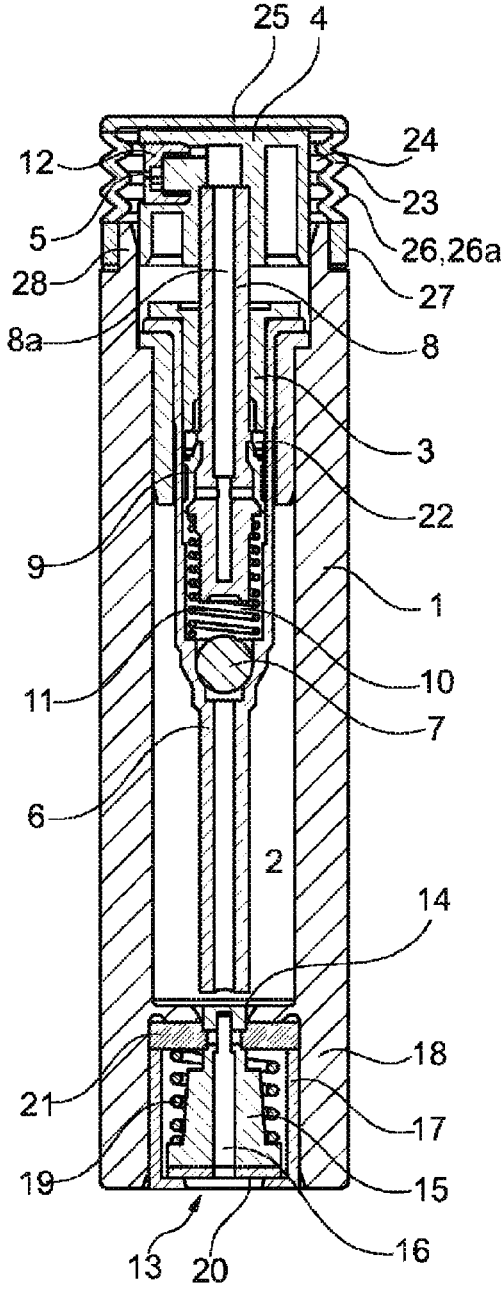
FIG. 4 shows a longitudinal section of a bottle for dispensing according to an embodiment of the invention.

In relation with FIG. 4, the skirt 26 has an elastically compressible zone 26*a* which is arranged between the upper wall 25 and the association surface 27, said zone being compressed via the air depression in order to provide for the maintaining of the push-button 4 in depressed position.

In particular, the compressible zone 26*a* is formed of a bellows made of elastically deformable material, with the upper wall 25 and/or the association surface 27 also able to be made from an elastically deformable material in order to prevent a use of the cap 23 when the reservoir 2 contains product.

What is claimed is:

1. A bottle for dispensing a fluid product, comprising:

a body wherein a reservoir containing said product is formed;

a device for sampling of said product which is mounted in a sealed manner on said body, said device for sampling being provided with a push-button which is provided with a dispensing orifice of said product, said push-button able to be displaced reversibly on an actuating stroke of said device between a position at rest and a depressed position wherein the dispensing orifice is in communication with the reservoir via said device;

said body being equipped with a filling valve of said reservoir which is arranged to allow for communication of a product source with said reservoir, the reservoir having an air depression which is arranged in order to be able to carry out the filling of the reservoir with product by putting into sealed communication of the product source with said reservoir by an intermediary of the filling valve in such a way that said depression induces the filling of said reservoir through suction of the product contained in said product source;

said bottle further comprising a removable cap which is associated to the body by forming a sealed internal space wherein said push-button is arranged, said internal space having an air depression and being arranged to maintain said push-button in depressed position in such a way that said internal space is in communication with the reservoir.

2. The bottle for dispensing according to claim 1, characterised in that the cap has an upper wall which is pressing against the push-button in order to maintain the push button in depressed position.

3. The bottle for dispensing according to claim 2, characterised in that the upper wall is surrounded by a skirt having a sealed association surface on a wall of the body.

4. The bottle for dispensing according to claim 1, characterised in that the sealed association between the cap and the body is carried out under the effect of the air depression.

5. The bottle for dispensing according to claim 3, characterised in that the association surface is deformed under the effect of the air depression in order to provide for a tight seal on the wall.

6. The bottle for dispensing according to claim 3, characterised in that the association surface is mounted around the wall in order to be radially tightened on said wall.

7. The bottle for dispensing according to claim 3, characterised in that the body has a groove wherein the association surface is arranged in order to be thrust against the corner on the wall.

8. The bottle for dispensing according to claim 3, characterised in that a seal is inserted between the association surface and the wall of the body.

9. The bottle for dispensing according to claim 3, characterised in that the skirt is rigid and has an axial dimension that is arranged to maintain the push-button in depressed position.

10. The bottle for dispensing according to claim 9, characterised in that the association surface has an axial dimension which is less than the actuating stroke of the push-button.

11. The bottle for dispensing according to claim 3, characterised in that the skirt has an elastically compressible zone which is arranged between the upper wall and the association surface, said zone being compressed by the air depression in order to provide for the maintaining of the push-button in depressed position.

12. The bottle for dispensing according to claim 1, characterised in that the device for sampling is of the airless type in the reservoir as compensation for the volume of product distributed.

13. The bottle for dispensing according to claim 1, characterised in that the device for sampling has a vent hole which is arranged to compensate for the volume of product sampled in the reservoir by air, said vent hole being in communication with the sealed internal space.

* * * * *